US005332078A

United States Patent [19]

Johnson et al.

[11] Patent Number: 5,332,078

[45] Date of Patent: Jul. 26, 1994

[54] BALUSTRADE HANDRAIL ENTRY GUARD

[75] Inventors: Gerald E. Johnson, Farmington; James A. Rivera, Bristol, both of Conn.

[73] Assignee: Otis Elevator Company, Farmington, Conn.

[21] Appl. No.: 127,214

[22] Filed: Sep. 27, 1993

[51] Int. Cl.[5] ..... B66B 29/08

[52] U.S. Cl. ..... 198/338

[58] Field of Search ..... 198/337, 338

[56] References Cited

U.S. PATENT DOCUMENTS

| | | | |
|---|---|---|---|
| 2,113,173 | 4/1938 | Dunn et al. | 198/338 |
| 2,550,918 | 5/1951 | Felix et al. | 198/338 |
| 2,846,045 | 8/1958 | Fowler | 198/338 X |
| 3,809,206 | 5/1974 | Bredehorn et al. | 198/338 X |
| 4,896,759 | 1/1990 | Badstuebner et al. | 198/338 X |
| 4,976,345 | 12/1990 | Adrian et al. | 198/338 X |

*Primary Examiner*—James R. Bidwell

[57] ABSTRACT

A handrail entry guard is provided having a pair of symmetrically opposed elastomeric halves for substantially surrounding a handrail of a balustrade when the guard is in a normal position. Each half includes a rear edge, a forward edge, and a top surface. The forward edge extends from the top surface to the rear edge along an arcuate path.

8 Claims, 2 Drawing Sheets

BALUSTRADE HANDRAIL ENTRY GUARD

BACKGROUND OF THE INVENTION

1. Technical Field

The present invention relates to balustrades for people moving devices in general, and to balustrade handrail entry guards in particular.

2. Background Art

For safety reasons, escalators and other people moving devices typically include a handrail for passengers to steady themselves on. The handrail travels a circuitous path around a balustrade assembly at approximately the same speed as the steps or belts of the device. In the exposed section of the path, handrail guides direct the handrail along the periphery of a plurality of balustrade panels. At each end of the device, the balustrade panels include a semicircularlike panel, or "newel" that the handrail follows around to reverse direction. On the lower part of each newel, the handrail enters the enclosed base of the balustrade assembly and thereafter travels through to the other end of the people moving device.

A person of skill in the art will recognize that the handrail entering the base of the balustrade creates a pinch point where foreign objects can become trapped between the moving handrail and the balustrade base. To avoid this problem it is known in the art to provide a deflector shield around the handrail where it enters the balustrade base.

U.S. Pat. No. 2,113,173 to Dunn et al., hereinafter referred to as Dunn, discloses a stairway handrail guard. Dunn's guard comprises two symmetrical horn-shaped casings arranged around the handrail which extends upwardly from the handrail opening. Dunn discloses further that each casing is formed with an integral flange at its base and is secured to the end plate of the balustrade by screws. The two casings form a slot along the bottom of handrail. Beveled surfaces along the slot, according to Dunn, prevent foreign objects from getting pinched in the slot.

DISCLOSURE OF THE INVENTION

It is an object of the present invention to provide a handrail entry guard which deflects foreign objects away from the handrail.

It is a further object of the present invention to provide a handrail entry guard which prevents or minimizes pinching of foreign objects between the entry guard and the handrail.

It is a still further object of the present invention to provide a handrail entry guard which may be retrofit on to existing balustrades.

It is a still further object of-the present invention to provide a handrail entry guard which is aesthetically pleasing.

According to the present invention, a handrail entry guard is provided having a pair of symmetrically opposed elastomeric halves for substantially surrounding a handrail of a balustrade when the guard is in a normal position. Each half includes a rear edge, a forward edge, and a top surface. The forward edge extends from the top surface to the rear edge along an arcuate path.

According to one aspect of the present invention, each half may be elastically deformed by a foreign object and subsequently returned to its original shape.

According to another aspect of the present invention, the halves may comprise a clear elastomeric polymer.

An advantage of the present invention is that one or both halves may be deflected away from the handrail, thereby preventing or minimizing any pinching of the foreign object between the guard and the handrail.

Another advantage of the present invention is that the forward edge of each deformable half tends to deflect foreign objects away from the handrail.

Another advantage of the present invention is that the clear elastomeric polymer does not detract from the aesthetic appeal of the balustrade.

The foregoing and other objects, features and advantages of the present invention will become more apparent in light of the following detailed description and accompanying drawings.

BEST MODE FOR CARRYING OUT THE INVENTION

Figure 1:
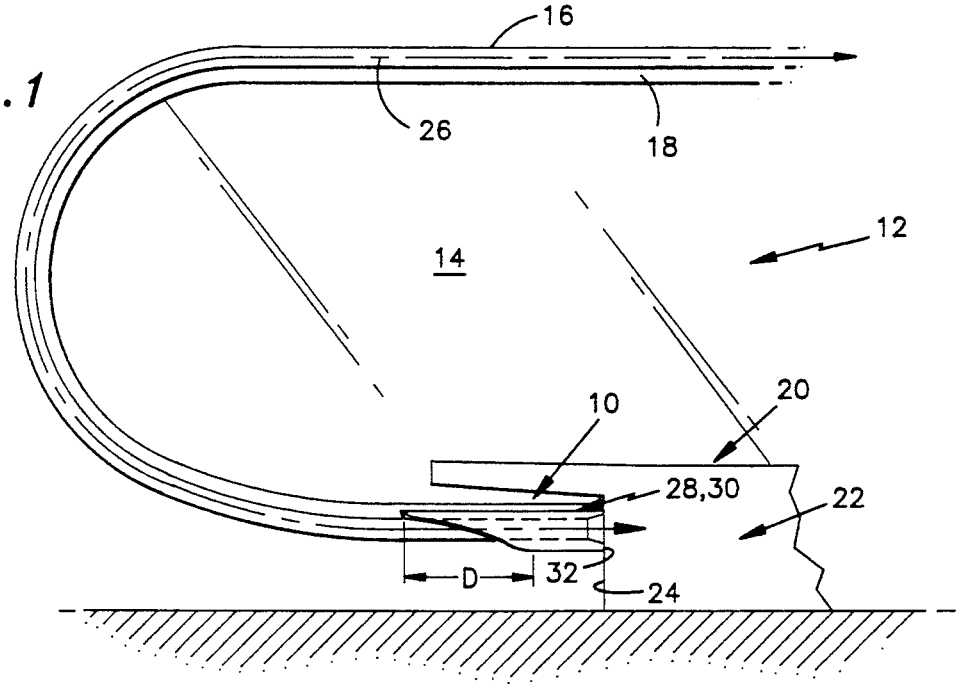
FIG. 1 is a diagrammatic side view of the present invention mounted on a balustrade assembly.

Referring to FIG. 1, a handrail entry guard 10 of the invention is shown mounted on a balustrade assembly 12 for an escalator. The balustrade assembly 12 includes a balustrade panel 14, a handrail 16, a handrail guide 18, and a base 20. The balustrade panel 14 extends out of, and is supported by the base 20. The base 20 comprises several enclosure panels 22, including an end panel 24, through which the handrail 16 passes. The handrail guide 18 is attached to the periphery of the balustrade panel 14. The handrail 16 follows the handrail guide 18 around the balustrade panel 14, into the base 20 of the balustrade. The longitudinal axis 26 of the handrail 16 extends along the lengthwise centerline of the handrail 16.

Figure 2:
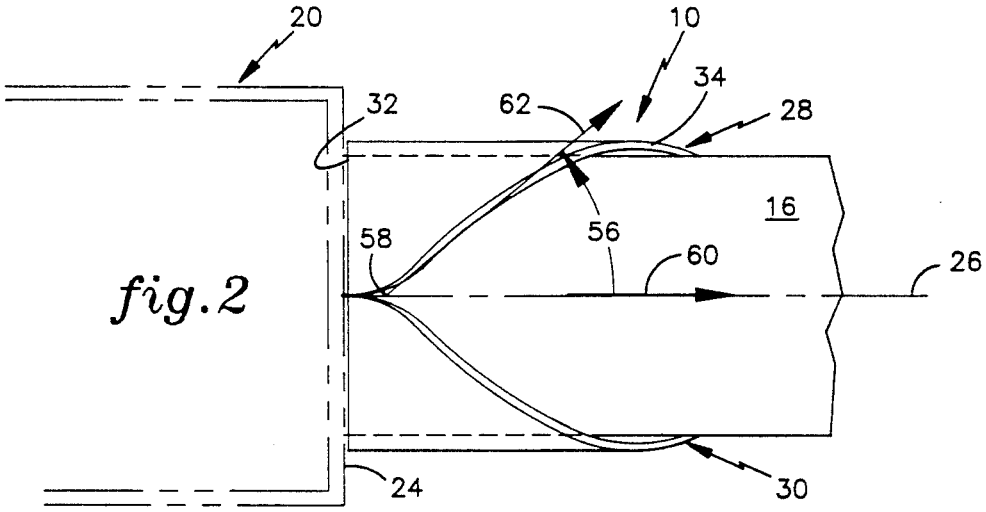
FIG. 2 is a bottom view of the diagrammatic view shown in FIG. 1.
Figure 3:
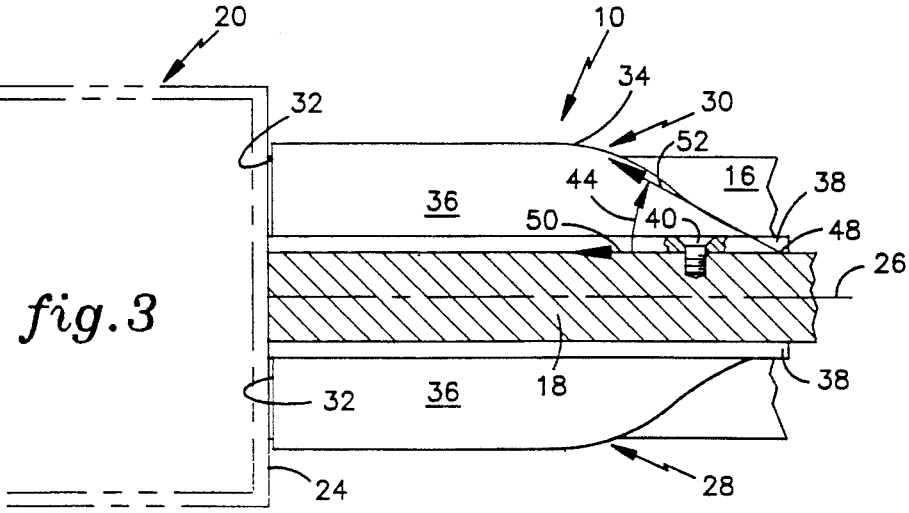
FIG. 3 is a top partial view of the diagrammatic view shown in FIG. 1.

Referring to FIGS. 2 and 3, the handrail entry guard 10 includes a pair of symmetrically opposed halves 28,30 made from clear elastomeric polymer. In other applications the halves 28,30 may be made from colored elastomerics. Each half 28,30 comprises a rear edge 32, a forward edge 34, and a top surface 36. In a first embodiment, the elastomeric halves 28,30 are independent of one another and the top surface 36 of each includes a flange 38. In a second embodiment, a midsection 42 connects the top surfaces 36 of the halves 28,30.

The forward edge 34 of each half 28,30 begins at the rear edge 32 and travels underneath the handrail for a distance parallel to the longitudinal axis 26 of the handrail 16 (see FIG. 2). Subsequently, the forward edge 34 of each halve 28,30 follows the contour of the handrail 16, around the handrail to the top surface 36 (see FIG. 3). The forward edge 34 forms an arcuate path from the rear edge 32 to the top surface 36. Viewed from the side (see FIG. 1), the arcuate path extends a distance "D" along the longitudinal axis 26 of the handrail 16.

Referring to FIG. 3, viewed from the top the arcuate path of the forward edge 34 forms an acute angle 44 between the forward edge 34 and a line parallel to the longitudinal axis 26; i.e. the origin 48 of the angle 44 is the point where forward edge 34 intersects handrail guide 18; the initial line 50 of the angle 44 is a ray extending along the handrail guide 18, parallel to the longitudinal axis 26; and the terminal line 52 of the angle 44 is a ray extending along the forward edge 34. The angle 44 is swept from the initial line 50 to the terminal line 52, through the material of the guard 10.

Referring to FIG. 2, viewed from the bottom the arcuate path of the forward edge 34 forms an acute angle 56 between the forward edge 34 and a line parallel to the longitudinal axis 26 of the handrail 16; i.e. the origin 58 of the angle 56 is the point where forward edge 34 intersects, or becomes parallel to, the longitudinal axis of the handrail 16; the initial line 60 of the angle 56 is a ray extending along the handrail guide 18, parallel to the longitudinal axis 26; and the terminal line 62 of the angle 56 is a ray extending along the forward edge. The angle 56 is swept from the initial line 60 to the terminal line 62, outside the material of the guard 10.

Referring to FIG. 1, in the operation of the escalator, a handrail entry guard 10 is positioned at each end of the balustrade at the point where the handrail 16 enters the end panel 24 of the balustrade base 20. Specifically, each handrail entry guard 10 is attached to the handrail guide 18 and positioned such that the rear edge 32 of each elastomeric half 28,30 (only one half is shown in FIG. 1) is adjacent the end panel 24. Each flange 38 is attached to the handrail guide 18 by conventional means, such as a screw 40 (see FIG. 3). In the second embodiment, the midsection 42 (see FIG. 4C) extending between the halves 28,30 connects each half to the other. Conventional means attach the midsection 42 to the handrail guide 18.

At one end of the balustrade assembly 12, the handrail 16 exits the base 20 of the balustrade, and passes through a handrail entry guard 10. The handrail 16 travels exposed along the periphery of the balustrade panels 14 towards the opposite end of the escalator. At the opposite end, the handrail 16 reverses direction around the newel 14 and enters a second handrail entry guard 10 attached to the handrail guide 18.

Figure 4A:
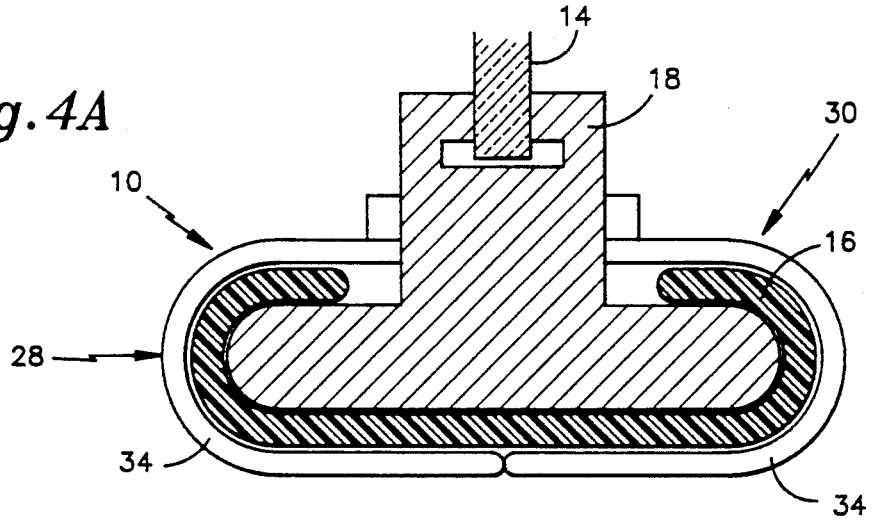
FIG. 4A is a cross section of the balustrade handrail entry guard of FIG. 1, shown in the normal position.
Figure 4B:
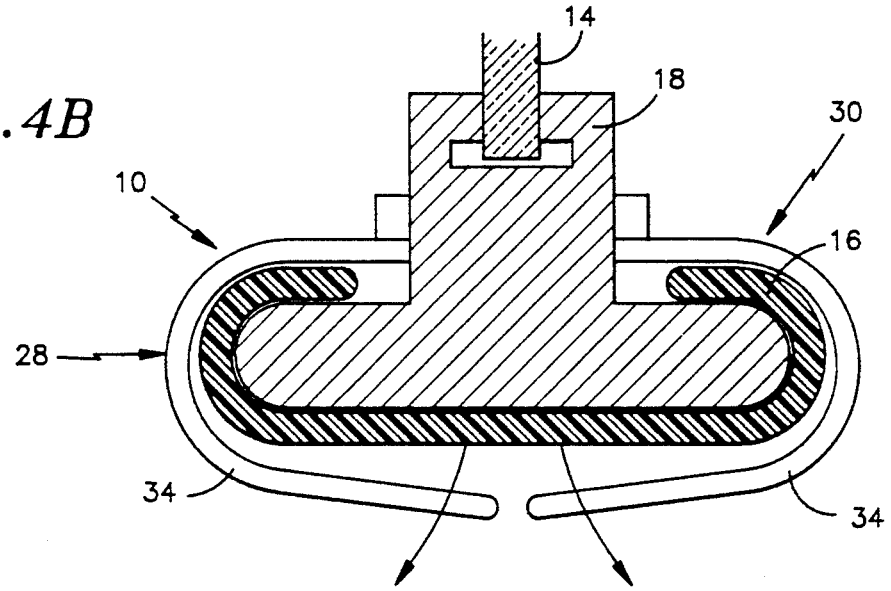
FIG. 4B is a cross section of the balustrade handrail entry guard of FIG. 1, shown in a deflected position.
Figure 4C:
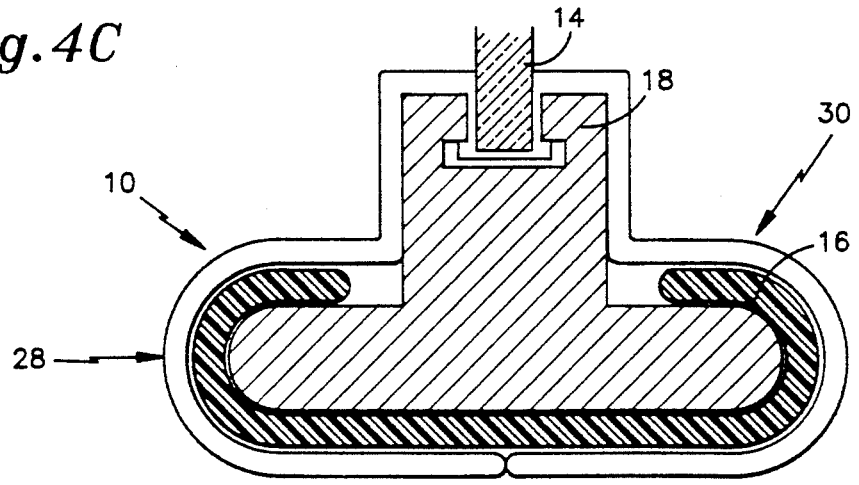
FIG. 4C is a cross section of the balustrade handrail entry guard showing a midsection joining the two halves.

Referring to FIGS. 4A–4C, in the event that a foreign object travels with the handrail 16 underneath newel 14, the foreign object will contact the handrail entry guard 10. The close proximity of the handrail entry guard 10 to the handrail 16, and the arcuate path of the forward edges 34 will, in most cases, cause the foreign object to be deflected away from the handrail 16. If the foreign object is not deflected, however, the half (or halves) 28,30 will be elastically deformed. Depending on the shape of the foreign object, each half 28,30 could be deformed down towards the handrail 16, or away from the handrail 16. In the former case, closing the gap between the handrail 16 and the entry guard 10 further facilitates the object being deflected away from the handrail 16. In the later case, the elastomeric half 28,30 deflecting away from the handrail 16 will allow the object to enter in between the guard 10 and the handrail 16 (see FIG. 4B). The amount of force applied on the object by the elastomeric half 28,30, however, is small enough to permit the object to be removed.

Although the invention has been shown and described with respect to a best mode embodiment thereof, it should be understood by those skilled in the art that various other changes, omissions and additions in the form and detail thereof may be made therein without departing from the spirit and scope of the invention.

We claim:

1. A handrail entry guard, for a balustrade assembly having a handrail and a handrail guide, wherein the handrail has a longitudinal axis extending along the centerline of the handrail, comprising:

a pair of symmetrically opposed elastomeric halves, for substantially surrounding a handrail of a balustrade if said guard is in a normal position, each half having a rear edge, a forward edge, and a top surface;

wherein said top surface of each half is attached the handrail guide, and said forward edge extends from said top surface to said rear edge along an arcuate path, wherein an acute angle is formed between said forward edge and the longitudinal axis of the handrail, and said forward edge tends to deflect foreign objects away from said handrail; and wherein either or both said halves may be deflected away from said handrail to facilitate the deflection of foreign objects away from said handrail.

2. A handrail entry guard according to claim 1, wherein said elastomeric halves are independent of each other, and the top surface of each half further comprises a flange, said flange being attached to the handrail guide.

3. A handrail entry guard according to claim 1, wherein said elastomeric halves are attached to each other by a midsection, which is, in turn, attached to said handrail guide.

4. A handrail entry guard according to claim 1, wherein said elastomeric halves may be deformed by a foreign object and subsequently returned to their original shape after said foreign object is expelled.

5. A handrail entry guard according to claim 1, wherein said arcuate forward edges begin at a point on said top surface above said handrail, and extend in the direction of said rear edge, diverging away from each other and wrapping around said handrail, thereafter meeting at a point below said handrail.

6. A handrail entry guard according to claim 2, wherein said arcuate forward edges begin at a point on said top surface above said handrail, and extend in the direction of said rear edge, diverging away from each other and wrapping around said handrail, thereafter meeting at a point below said handrail.

7. A handrail entry guard according to claim 3, wherein said arcuate forward edges begin at a point on said top surface above said handrail, and extend in the direction of said rear edge, diverging away from each other and wrapping around said handrail, thereafter meeting at a point below said handrail.

8. A handrail entry guard according to claim 4, wherein said arcuate forward edges begin at a point on said top surface above said handrail, and extend in the direction of said rear edge, diverging away from each other and wrapping around said handrail, thereafter meeting at a point below said handrail.

* * * * *